US009574798B2

(12) United States Patent
Hiratsuka et al.

(10) Patent No.: US 9,574,798 B2
(45) Date of Patent: Feb. 21, 2017

(54) U-SHAPED PULSE-TUBE REFRIGERATOR

(71) Applicant: SUMITOMO HEAVY INDUSTRIES, LTD., Tokyo (JP)

(72) Inventors: Yoshikatsu Hiratsuka, Tokyo (JP); Kyosuke Nakano, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 340 days.

(21) Appl. No.: 14/188,792

(22) Filed: Feb. 25, 2014

(65) Prior Publication Data

US 2014/0290276 A1 Oct. 2, 2014

(30) Foreign Application Priority Data

Mar. 26, 2013 (JP) ..... 2013-065160

(51) Int. Cl.
*F25B 9/00* (2006.01)
*F25B 9/14* (2006.01)

(52) U.S. Cl.
CPC ..... *F25B 9/145* (2013.01); *F25B 2309/1408* (2013.01); *F25B 2309/1413* (2013.01)

(58) Field of Classification Search
CPC ..... F25B 9/145; F25B 2309/1408; F25B 2309/1413
See application file for complete search history.

(56) References Cited

U.S. PATENT DOCUMENTS 6,343,475 B1 * 2/2002 Ishikawa ..... F25B 9/145 62/6
2007/0157632 A1 * 7/2007 Saito ..... F25B 9/145 62/6

FOREIGN PATENT DOCUMENTS

JP 2001-165517 6/2001
JP 2001-289523 10/2001

* cited by examiner

*Primary Examiner* — Jonathan Bradford
*Assistant Examiner* — Elizabeth Martin
(74) *Attorney, Agent, or Firm* — IPUSA, PLLC

(57) ABSTRACT

A U-shaped pulse-tube refrigerator includes a regenerative tube and a pulse-tube that are juxtaposed with each other; a communicating path that connects a low-temperature end of the regenerative tube and a low-temperature end of the pulse-tube; a heat exchanger that is provided at the low-temperature end of at least one of the regenerative tube and the pulse-tube; and a flow smoothing member that is provided between a first exit of the communicating path at a side where the heat exchanger is provided and the heat exchanger.

8 Claims, 5 Drawing Sheets

U-SHAPED PULSE-TUBE REFRIGERATOR

CROSS-REFERENCE TO RELATED APPLICATION

The present application is based on and claims the benefit of priority of Japanese Priority Application No. 2013-065160 filed on Mar. 26, 2013, the entire contents of which are hereby incorporated by reference.

BACKGROUND

1. Field of the Invention

The present invention relates to a pulse-tube refrigerator and more specifically, to a U-shaped stirling pulse-tube refrigerator.

2. Description of the Related Art

An in-line pulse-tube refrigerator in which a compressor, a regenerator and a pulse-tube are serially placed, or a U-shaped pulse-tube refrigerator in which a regenerator and a pulse-tube are juxtaposed with each other is known as a so-called stirling pulse-tube refrigerator (Japanese Laid-open Patent Publication No. 2001-289523, for example).

In such a stirling pulse-tube refrigerator, working frequency of working gas is on the order of a few dozen kHz and the working gas reciprocates in the refrigerator at an extremely high-speed. This feature is largely different from those of a so-called Gifford-McMahon pulse-tube refrigerator whose working frequency of working gas is about 1 to 2 Hz.

However, even for such a stirling pulse-tube refrigerator, it is still highly required to further improve the cooling efficiency.

SUMMARY

The present invention is made in light of the above problems, and provides a U-shaped stirling pulse-tube refrigerator in which the cooling efficiency is further improved.

According to an embodiment, there is provided a U-shaped pulse-tube refrigerator includes a regenerative tube and a pulse-tube that are juxtaposed with each other; a communicating path that connects a low-temperature end of the regenerative tube and a low-temperature end of the pulse-tube; a heat exchanger that is provided at the low-temperature end of at least one of the regenerative tube and the pulse-tube; and a flow smoothing member that is provided between a first exit of the communicating path at a side where the heat exchanger is provided and the heat exchanger.

Note that also arbitrary combinations of the above-described elements, and any changes of expressions in the present invention, made among methods, devices, systems and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION

Before describing an embodiment, a structure and an operation of a general U-shaped stirling pulse-tube refrigerator are briefly explained with reference to FIG. 1 in order to facilitate the understanding of the embodiment.

Figure 1:
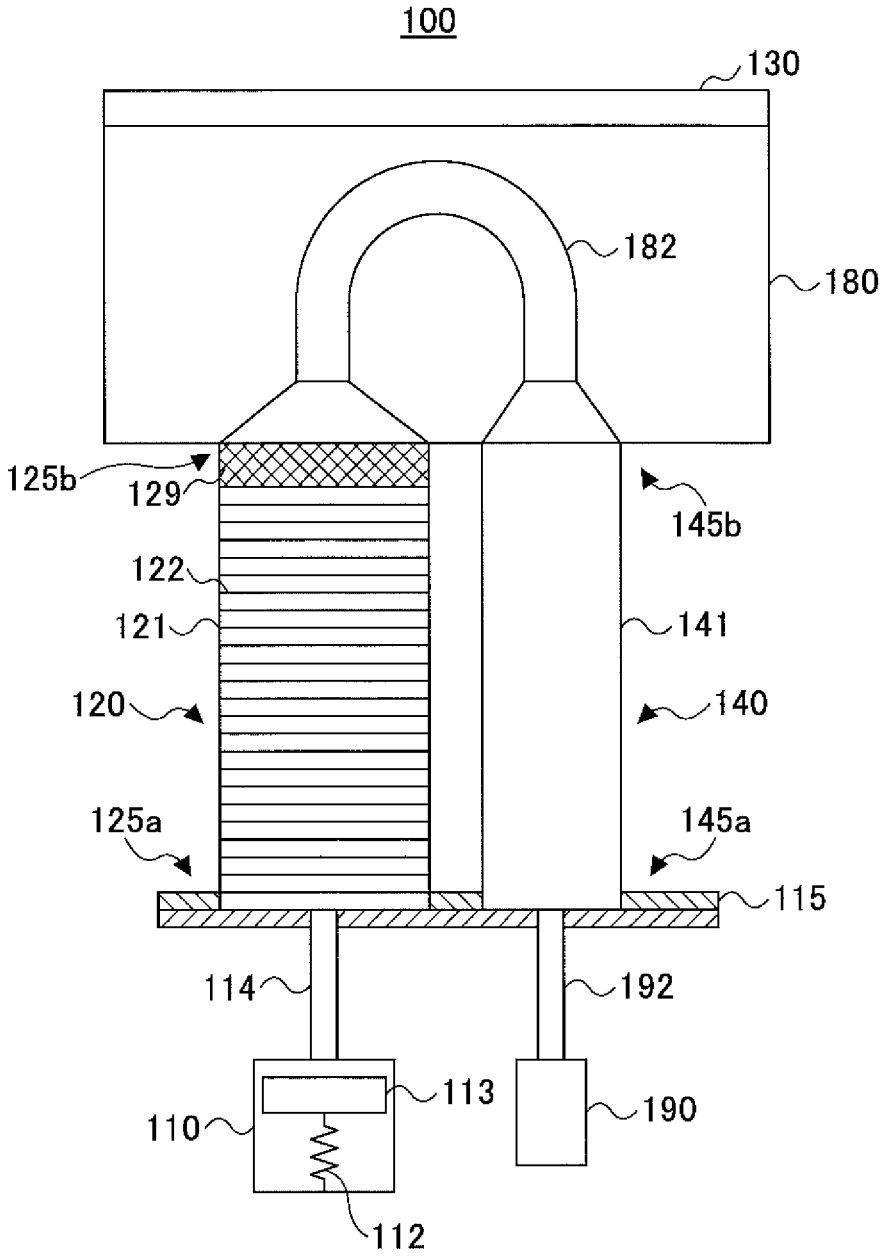
FIG. 1 is a schematic view illustrating an example of a structure of a general U-shaped stirling pulse-tube refrigerator.

FIG. 1 is a schematic view illustrating an example of a structure of a general U-shaped stirling pulse-tube refrigerator 100.

As illustrated in FIG. 1, the U-shaped pulse-tube refrigerator 100 includes a compressor 110, a regenerative tube 120, a pulse-tube 140, a cooling stage 180 and a buffer tank 190. The regenerative tube 120 includes a high-temperature end 125*a* and a low-temperature end 125*b*. The pulse-tube 140 includes a high-temperature end 145*a* and a low-temperature end 145*b*.

The compressor 110 includes, inside its cylinder, a spring 112 and a piston 113 that is supported by the spring 112 to be reciprocated. The compressor 110 is connected to the high-temperature end 125*a* of the regenerative tube 120 via a gas passage 114.

The regenerative tube 120 is structured by a hollow cylinder 121 and a regenerator material 122 is filled in the hollow cylinder 121. Further, a low-temperature heat exchanger 129 is provided at the low-temperature end 125*b* of the regenerative tube 120.

The pulse-tube 140 is structured by a hollow cylinder 141.

The low-temperature end 125*b* of the regenerative tube 120 and the low-temperature end 145*b* of the pulse-tube 140 contact and are fixed to the cooling stage 180. The low-temperature end 125*b* of the regenerative tube 120 and the low-temperature end 145*b* of the pulse-tube 140 are in communication with each other via a communicating path 182 provided in the cooling stage 180. The cooling stage 180 is thermally connected to an object so that the object to be cooled 130 is cooled.

The buffer tank 190 is connected to the high-temperature end 145*a* of the pulse-tube 140 via a gas passage 192.

The high-temperature end 125*a* of the regenerative tube 120 and the high-temperature end 145*a* of the pulse-tube 140 are connected to a flange 115 and fixed by the flange 115.

Next, the operation of the U-shaped stirling pulse-tube refrigerator 100 is briefly explained.

First, by a compressing operation of the compressor 110, working gas is compressed by the piston 113. The compressed working gas is provided from the compressor 110 to the regenerative tube 120 via the gas passage 114. The working gas flowed into the regenerative tube 120 is cooled by the regenerator material 122 and reaches the low-temperature end 125*b* of the regenerative tube 120 while the temperature of which is being lowered. The working gas is further cooled by the low-temperature heat exchanger 129 provided at the low-temperature end 125*b* side of the regenerative tube 120 and then is flowed into the pulse-tube 140 via the communicating path 182.

At this time, the low-pressure working gas that previously exists in the pulse-tube 140 is compressed by the high-pressure working gas that is flowed into the pulse-tube 140. With this, the pressure of the working gas in the pulse-tube 140 becomes higher than that in the buffer tank 190 so that the working gas is flowed into the buffer tank 190 via the gas passage 192.

Then, when the compressor 110 expands and the piston 113 performs an absorbing operation, the working gas in the pulse-tube 140 is flowed into the low-temperature end 125*b* of the regenerative tube 120 from the low-temperature end 145*b*. The working gas further passes through the regenerative tube 120 and is collected into the compressor 110 from the high-temperature end 125*a* via the gas passage 114.

Here, as described above, the pulse-tube 140 is connected to the buffer tank 190 via the gas passage 192. Thus, the phase of the pressure change of the working gas and the phase of the volume change of the working gas vary with a predetermined phase difference. Cooling is generated by the expansion of the working gas at the low-temperature end 145*b* of the pulse-tube 140 caused by the phase difference.

Thus, by repeating the above operation, the object to be cooled 130 connected to the cooling stage 180 can be cooled.

Further, in the U-shaped stirling pulse-tube refrigerator 100, working frequency of working gas is on the order of a few dozen kHz and the working gas reciprocates in the refrigerator 100 at an extremely high-speed.

Here, for the U-shaped pulse-tube refrigerator 100 as illustrated in FIG. 1, there is a problem that there exists a limitation in improving the cooling efficiency and it is difficult to further improve its cooling efficiency. This problem is explained with reference to FIG. 2.

Figure 2:
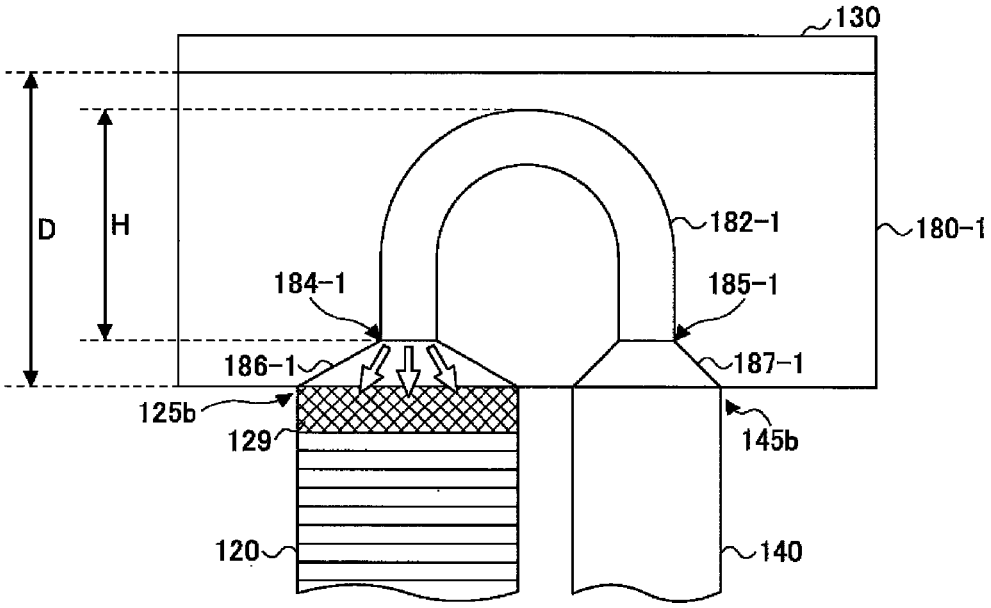
FIG. 2 is a schematic cross-sectional view illustrating an example of a cooling stage of the general U-shaped pulse-tube refrigerator.

FIG. 2 is an enlarged schematic cross-sectional view illustrating a cooling stage 180-1 (an example of the cooling stage 180) of the general U-shaped pulse-tube refrigerator 100.

As illustrated in FIG. 2, the object to be cooled 130 is attached at an end of the cooling stage 180-1. Further, a communicating path 182-1 that connects the low-temperature end 125*b* of the regenerative tube 120 and the low-temperature end 145*b* of the pulse-tube 140 is provided in the cooling stage 180-1.

More specifically, a first exit 184-1 and a second exit 185-1 are provided at the regenerative tube 120 side and the pulse-tube 140 side of the communicating path 182-1 in the cooling stage 180-1, respectively. Further, a first space portion 186-1 is provided between the first exit 184-1 of the communicating path 182-1 and the regenerative tube 120, and a second space portion 187-1 is provided between the second exit 185-1 of the communicating path 182-1 and the pulse-tube 140.

The first space portion 186-1 has a tapered shape whose diameter increases toward the regenerative tube 120. Similarly, the second space portion 187-1 has a tapered shape whose diameter increases toward the pulse-tube 140.

Here, normally, the diameter of the regenerative tube 120 is larger than the diameter of the pulse-tube 140. Thus, normally, the diameter contraction ratio of the tapered shape of the first space portion 186-1 is larger than that of the tapered shape of the second space portion 187-1. In other words, the ratio of the diameter of the regenerative tube 120 to the diameter of the communicating path 182-1 is larger than the ratio of the diameter of the pulse-tube 140 to the diameter of the communicating path 182-1.

The first space portion 186-1 has a function to make the flow of the working gas that flows from the pulse-tube 140 to the regenerative tube 120 uniform (see arrows in FIG. 2). Similarly, the second space portion 187-1 has a function to make the flow of the working gas that flows from the regenerative tube 120 to the pulse-tube 140 uniform.

Here, the cross-section of the communicating path 182-1 in a direction substantially parallel to the flow direction of the working gas (a direction parallel to the sheet of the drawing) has a substantially semicircle shape. Thus, the height "H" of the communicating path 182-1 is relatively large (the radius of curvature of the communicating path 182-1 is relatively small).

When the cooling stage 180-1 has such a structure, the distance "D" between the low-temperature heat exchanger 129 provided at the low-temperature end 125*b* of the regenerative tube 120 and the object to be cooled 130 becomes relatively large. Thus, with such a structure of the cooling stage 180-1, a loss of cooling by heat conduction may be easily caused while the cooling at the low-temperature heat exchanger 129 is transmitted to the object to be cooled 130. As a result, it is difficult to further improve the cooling efficiency of the refrigerator.

Thus, in order to shorten the distance "D" between the low-temperature heat exchanger 129 and the object to be cooled 130, the shape of the communicating path 182-1 (specifically the height "H") may be changed.

Figure 3:
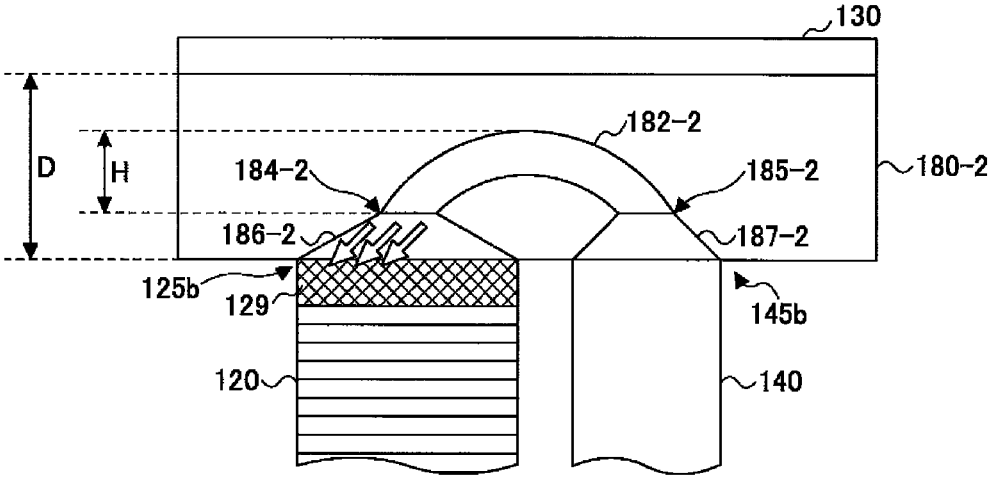
FIG. 3 is a schematic cross-sectional view illustrating a cooling stage of a U-shaped pulse-tube refrigerator of a comparative example.

FIG. 3 is a schematic cross-sectional view illustrating an example of a cooling stage 180-2 (another example of the cooling stage 180) including a communicating path 182-2 whose structure is different from the communicating path 182-1 illustrated in FIG. 2.

For the example illustrated in FIG. 3, the radius of curvature of the communicating path 182-2 in the cooling stage 180-2 is made to be larger than that of the communicating path 182-1 illustrated in FIG. 2, in the direction substantially parallel to the flow direction of the working gas (the direction parallel to the sheet of the drawing). Thus, the height "H" for the communicating path 182-2 is reduced compared with the height "H" for the communicating path 182-1 illustrated in FIG. 2.

In this case, as the distance "D" between the low-temperature heat exchanger 129 provided at the low-temperature end 125*b* of the regenerative tube 120 and the object to be cooled 130 becomes small, the loss by the heat conduction may be reduced to a certain extent.

However, in this case, as illustrated by arrows in FIG. 3, when the working gas flows from the pulse-tube 140 to the regenerative tube 120, the flow of the working gas deviates at an interface between a first space portion 186-2 and the low-temperature heat exchanger 129, which causes a problem that the working gas hardly flows uniformly in the entirety of the low-temperature heat exchanger 129.

In particular, for the U-shaped stirling pulse-tube refrigerator 100, as the flow rate of the working gas flowing therethrough is relatively large, the problem of the deviation of the working gas may be significant. Thus, even with the cooling stage 180-2 as illustrated in FIG. 3, cooling efficiency of the refrigerator cannot be improved enough.

As such, it is difficult to improve cooling efficiency of a U-shaped pulse-tube refrigerator.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

According to the present embodiment, as will be explained in detail in the following, it is possible to suppress a deviation of working gas that flows into a regenerative tube while maintaining the distance "D" between a low-temperature heat exchanger and an object to be cooled short. Thus, according to the embodiment, it is possible to significantly improve cooling efficiency of a U-shaped pulse-tube refrigerator.

(U-Shaped Pulse-Tube Refrigerator of Embodiment)

Next, a U-shaped pulse-tube refrigerator 200 (hereinafter, referred to as a "first U-shaped pulse-tube refrigerator 200") of the embodiment is explained with reference to FIG. 4.

Figure 4:
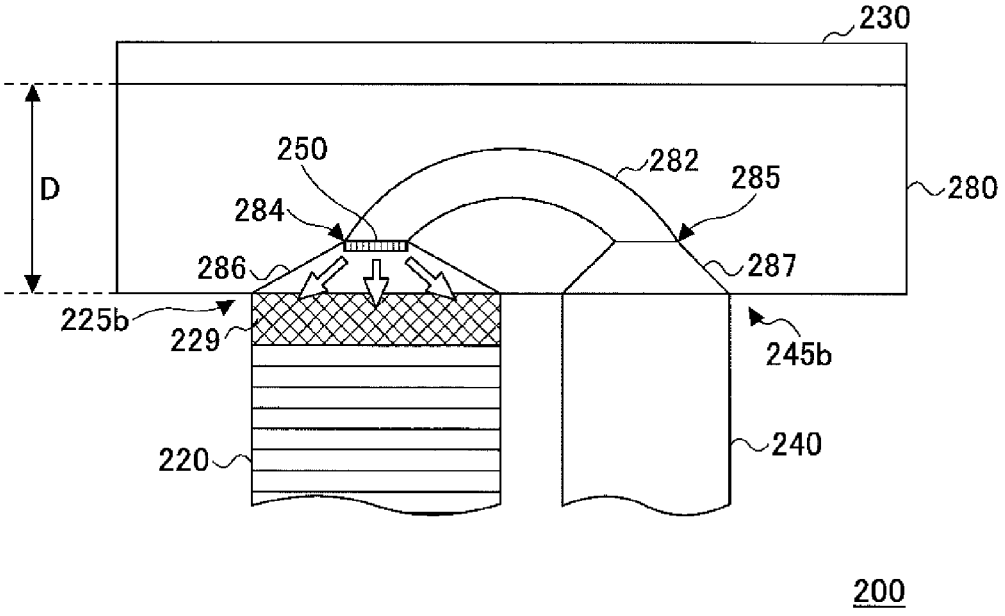
FIG. 4 is a schematic cross-sectional view partially illustrating an example of a structure of a U-shaped stirling pulse-tube refrigerator of an embodiment.

FIG. 4 is a schematic cross-sectional view partially illustrating an example of a structure of the first U-shaped stirling pulse-tube refrigerator 200 of the embodiment including a cooling stage 280.

The first U-shaped pulse-tube refrigerator 200 basically has the same structure as the general U-shaped pulse-tube refrigerator 100 as illustrated in FIG. 1. Thus, only the specific parts of the first U-shaped pulse-tube refrigerator 200, in other words, a structure and an operation of the cooling stage 280 are mainly explained.

With reference to FIG. 1 as well, the first U-shaped stirling pulse-tube refrigerator 200 includes the compressor 110, the flange 115 and the buffer tank 190. The first U-shaped stirling pulse-tube refrigerator 200 further includes a regenerative tube 220, a pulse-tube 240, the cooling stage 280 and a low-temperature heat exchanger 229 instead of the regenerative tube 120, the pulse-tube 140, the cooling stage 180 and the low-temperature heat exchanger 129 in FIG. 1, respectively.

Similar to the regenerative tube 120, the regenerative tube 220 includes a high-temperature end (not illustrated in FIG. 4) and a low-temperature end 225*b*. Similar to the pulse-tube 140, the pulse-tube 240 includes a high-temperature end (not illustrated in FIG. 4) and a low-temperature end 245*b*.

The cooling stage 280 of the first U-shaped pulse-tube refrigerator 200 is provided to be connected to the low-temperature end 225*b* of the regenerative tube 220 and the low-temperature end 245*b* of the pulse-tube 240. The low-temperature heat exchanger 229 is provided at the low-temperature end 225*b* of the regenerative tube 220. An object to be cooled 230 is attached at an end of the cooling stage 280.

A communicating path 282 is provided in the cooling stage 280 that connects the low-temperature end 225*b* of the regenerative tube 220 and the low-temperature end 245*b* of the pulse-tube 240.

The communicating path 282 is provided with a first exit 284 and a second exit 285 at the regenerative tube 220 side and the pulse-tube 240 side, respectively. Further, a first space portion 286 is provided between the first exit 284 of the communicating path 282 and the regenerative tube 220 and a second space portion 287 is provided between the second exit 285 of the communicating path 282 and the pulse-tube 240.

The first space portion 286 has a tapered shape whose diameter increases toward the regenerative tube 220. Similarly, the second space portion 287 has a tapered shape whose diameter increases toward the pulse-tube 240.

Here, normally, the diameter of the regenerative tube 220 is larger than the diameter of the pulse-tube 240. Thus, normally, the diameter contraction ratio of the tapered shape of the first space portion 286 is larger than that of the tapered shape of the second space portion 287. In other words, the ratio of the diameter of the regenerative tube 220 to the diameter of the communicating path 282 is larger than the ratio of the diameter of the pulse-tube 240 to the diameter of the communicating path 282.

Here, the communicating path 282 in the cooling stage 280 is configured, similar to the communicating path 182-2 illustrated in FIG. 3, such that the radius of curvature is large, in the direction substantially parallel to the flow direction of the working gas (the direction parallel to the sheet of the drawing).

Thus, according to the cooling stage 280 of the first U-shaped pulse-tube refrigerator 200, the distance "D" between the low-temperature heat exchanger 229 provided at the low-temperature end 225*b* of the regenerative tube 220 and the object to be cooled 230 is relatively small. Further, with this configuration, the loss by the heat conduction between the low-temperature heat exchanger 229 and the object to be cooled 230 can be significantly suppressed.

The first U-shaped pulse-tube refrigerator 200 further includes a flow smoothing member 250.

The flow smoothing member 250 has a function to smooth the flow of the working gas to be uniform when the working gas introduced into the communicating path 282 from the low-temperature end 245*b* of the pulse-tube 240 flows into the low-temperature end 225*b* of the regenerative tube 220.

For example, for the example illustrated in FIG. 4, the flow smoothing member 250 is provided in the first space portion 286. The flow smoothing member 250 functions to uniformalize the flow of the working gas flowing from the communicating path 282 toward the low-temperature end 225*b* of the regenerative tube 220 in the first space portion 286. Thus, as illustrated in arrows in FIG. 4, the working gas flowing from the communicating path 282 to the regenerative tube 220 is uniformalized in the first space portion 286 to be flowed into the low-temperature heat exchanger 229 provided at the low-temperature end 225*b* of the regenerative tube 220.

By providing the flow smoothing member 250, the deviation of the working gas can be significantly suppressed when the working gas is flowed from the low-temperature end 245*b* of the pulse-tube 240 to the low-temperature end 225*b* of the regenerative tube 220.

Thus, according to the first U-shaped pulse-tube refrigerator 200, it is possible to suppress the deviation of the working gas that flows into the regenerative tube 220 while maintaining the distance "D" between the low-temperature heat exchanger 229 and the object to be cooled 230 short. Further, with this, according to the first U-shaped pulse-tube refrigerator 200, cooling efficiency of the U-shaped pulse-tube refrigerator can be significantly improved.

Here, the structure of the flow smoothing member 250 is not limited to the specific examples as long as the flow smoothing member 250 has a function to smooth the flow of the working gas to be uniform.

The flow smoothing member 250 may include a plurality of through holes that extend from the first exit 284 of the communicating path 282 toward the low-temperature end 225*b* of the regenerative tube 220 side (in other words, toward the first space portion 286).

Figure 5:
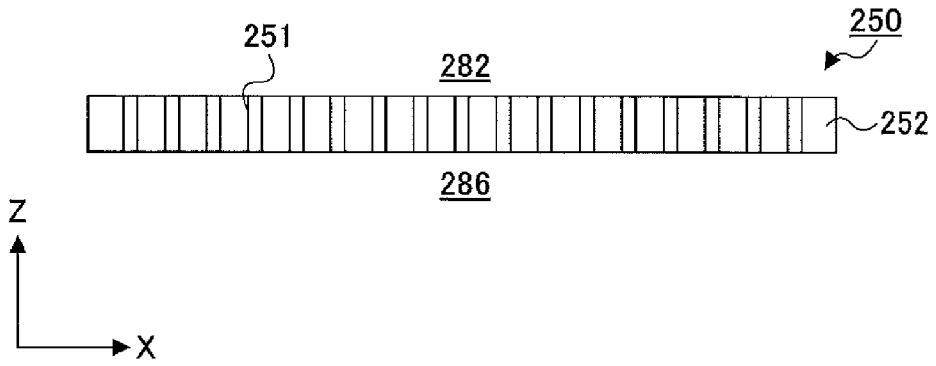
FIG. 5 is a schematic cross-sectional view illustrating an example of a structure of a flow smoothing member of the U-shaped stirling pulse-tube refrigerator of the embodiment.

FIG. 5 is a schematic cross-sectional view illustrating an example of a structure of the flow smoothing member 250 provided with such plurality of through holes. In FIG. 5, the upper side corresponds to the communicating path 282 side and the lower side corresponds to the first space portion 286 side. As illustrated in FIG. 5, the flow smoothing member 250 includes a circular plate 252 (an example of a block body) that is provided to block the flow of the working gas from the first exit 284 toward the low-temperature heat exchanger 229. Further, the circular plate 252 is provided with a plurality of through holes 251 such that the working gas flows through the plurality of through holes 251 from the first exit 284 toward the low-temperature heat exchanger 229. Specifically, in this example, the circular plate 252 is provided to block the first exit 284 of the communicating path 282. Further, the through holes 251 are provided such that each extends in the longitudinal direction (Z-direction in FIG. 5) of the regenerative tube 220. The through holes 251 may be dispersedly provided at the entirety of the circular plate 252.

Figure 6:
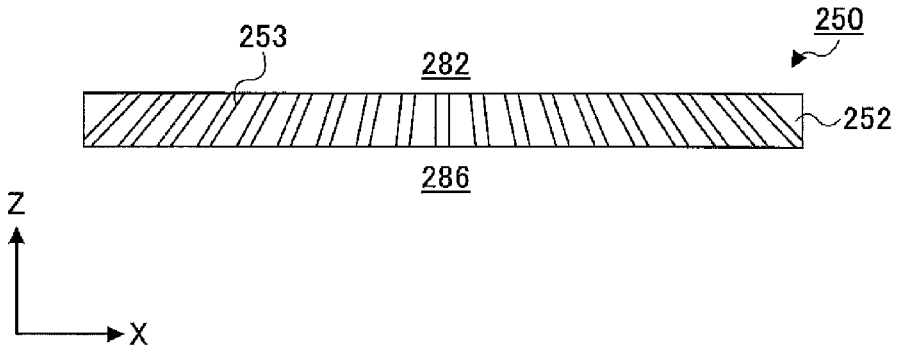
FIG. 6 is a schematic cross-sectional view illustrating another example of a structure of the flow smoothing member of the U-shaped stirling pulse-tube refrigerator of the embodiment.

FIG. 6 is a schematic cross-sectional view illustrating another example of a structure of the flow smoothing member 250. In FIG. 6, the upper side corresponds to the communicating path 282 side and the lower side corresponds to the first space portion 286 side. As illustrated in FIG. 6, the flow smoothing member 250 may include the circular plate 252 provided with a plurality of through holes 253 that radially extend from the first exit 284 of the communicating path 282 side toward the first space portion 286. In other words, the through holes 253 at outside of the circular plate 252 may extend in a more inclined direction than the through holes 252 at a center side of the circular plate 252.

For the examples illustrated in FIG. 5 and FIG. 6, the through holes 251 may be uniformly provided at the entirety of the circular plate 252 or alternatively, nonuniformly provided at the circular plate 252.

The flow smoothing member 250 provided with a plurality of through holes may be in various forms such as, for example, a mesh, a gauze, a punched plate and/or a porous plate.

Further, for the example illustrated in FIG. 4, the flow smoothing member 250 is provided to be in contact with the first exit 284 of the communicating path 282. However, the position of the flow smoothing member 250 is not so limited. That is, the flow smoothing member 250 may be provided at any position in the first space portion 286. However, the flow smoothing member 250 may be provided to be in contact with the first exit 284 of the communicating path 282, as the example illustrated in FIG. 4, so that a large (maximum) uniformizing effect can be obtained.

Alternatively, the flow smoothing member 250 may be provided with a plurality of through holes that radially extend in a plane that is substantially perpendicular to the longitudinal axis of the regenerative tube 220, for example. Further, the flow smoothing member may be provided with both of the plurality of through holes that extend from the first exit 284 of the communicating path 282 toward the low-temperature end 225*b* of the regenerative tube 220 side and the plurality of through holes that radially extend in the plane that is substantially perpendicular to the longitudinal axis of the regenerative tube 220.

Such a flow smoothing member may be structured by a block shaped structure, for example.

Figure 7:
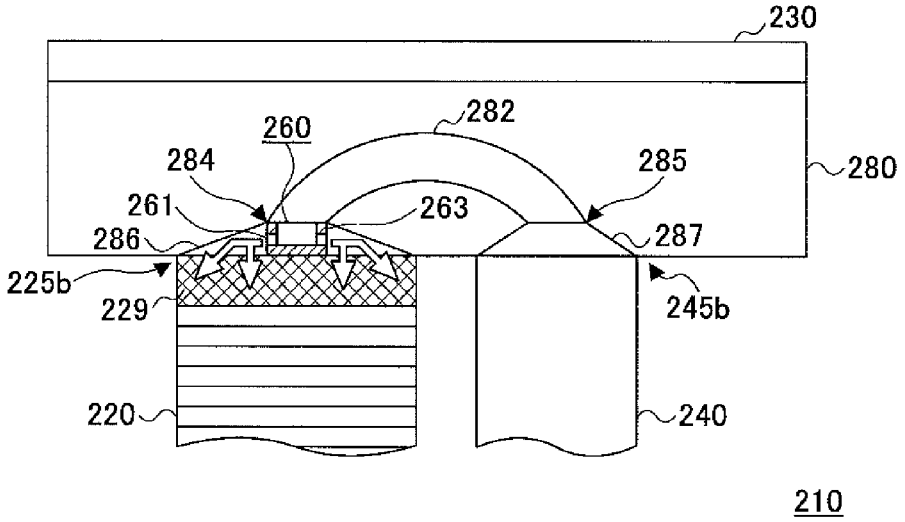
FIG. 7 is a schematic cross-sectional view illustrating another example of a structure of the cooling stage of the U-shaped stirling pulse-tube refrigerator of the embodiment.

FIG. 7 is an enlarged schematic cross-sectional view illustrating another example of a structure of a cooling stage of a U-shaped stirling pulse-tube refrigerator 210 (hereinafter, referred to as a "second U-shaped pulse-tube refrigerator 210") of the embodiment. For the example illustrated in FIG. 7, a block shaped structure 260 is used as the flow smoothing member.

Figure 8:
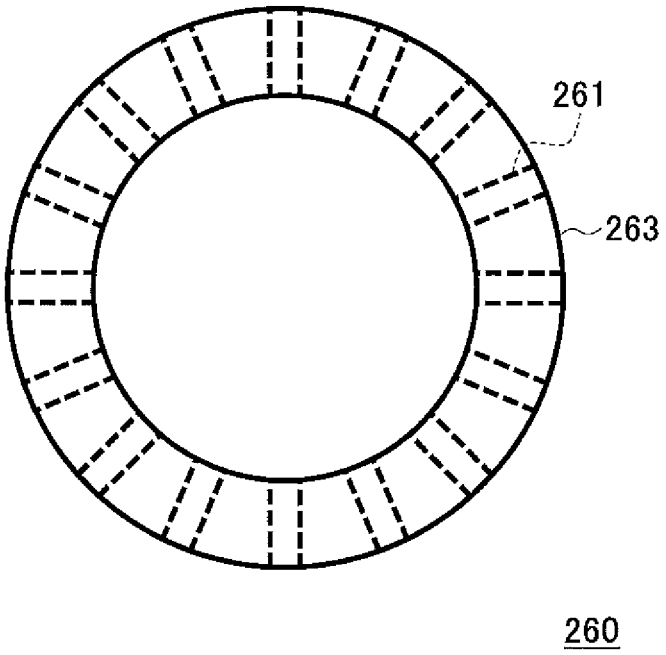
FIG. 8 is a schematic plan view illustrating an example of a structure of through holes provided at a side wall of a block shaped structure.

As illustrated in FIG. 7, the block shaped structure 260 has a substantially circular pipe (an example of the block body) whose bottom surface is closed. The block shaped structure 260 is placed such that its upper surface contacts the first exit 284 of the communicating path 282. The diameter of the block shaped structure 260 may be substantially the same as the diameter of the communicating path 282 so that the block shaped structure 260 blocks the first exit 284 of the communicating path 282. The block shaped structure 260 is provided with a plurality of through holes 261 radially formed at a side wall 263 of the circular pipe. FIG. 8 is a schematic plan view illustrating an example of a structure of the through holes 261 provided at the side wall 263 of the block shaped structure 260.

When the block shaped structure 260 is used as the flow smoothing member, the working gas that flows from the communicating path 282 toward the regenerative tube 220 is flowed into the low-temperature heat exchanger 229 provided at the low-temperature end 225*b* of the regenerative tube 220 after radially dispersing in the first space portion 286 as illustrated by arrows in FIG. 7.

Thus, according to the second U-shaped pulse-tube refrigerator 210, the deviation of the working gas can be significantly suppressed when the working gas flows into the low-temperature end 225*b* of the regenerative tube 220 from the low-temperature end 245*b* of the pulse-tube 240.

As such, according to the second U-shaped pulse-tube refrigerator 210 as well, it is possible to suppress the deviation of the working gas that flows into the regenerative tube 220 while maintaining the distance "D" between the low-temperature heat exchanger 229 and the object to be cooled 230 short. Further, with this, according to the second U-shaped pulse-tube refrigerator 210, cooling efficiency of the U-shaped pulse-tube refrigerator can be significantly improved.

Examples of the embodiment are explained with reference to FIG. 4 to FIG. 8. However, it is to be understood that minor modifications may be made therein without departing from the spirit and scope of the invention as defined by the claims.

For example, according to the embodiment, the U-shaped pulse-tube refrigerator is explained with reference to FIG. 4 and FIG. 8 in which the low-temperature heat exchanger is provided at the low-temperature end of the regenerative tube.

However, a U-shaped pulse-tube refrigerator in which a low-temperature heat exchanger is provided at a low-temperature end of a pulse-tube in addition to the above structure, or instead of the above structure may be used. In such a case, a member similar to the flow smoothing member as illustrated in FIG. 4 or FIG. 7 may be provided at a second exit (in other words, at the exit of the pulse-tube) of a communicating path in the U-shaped pulse-tube refrigerator. With this, it is possible to suppress the deviation of the working gas that flows into the low-temperature end of the pulse-tube while maintaining the distance between the object to be cooled and the low-temperature heat exchanger provided at the pulse-tube short. Further, with this, cooling efficiency of the U-shaped pulse-tube refrigerator can be significantly improved.

Further, according to the U-shaped pulse-tube refrigerator of the embodiment illustrated in FIG. 4 or FIG. 7, the first space portion 286 has the tapered shape whose diameter increases toward the regenerative tube 220. However, alternatively, the first space portion 286 may not have the tapered shape. In other words, the first space portion 286 may have the same diameter (the size) from the first exit 284 to the low-temperature end 225*b* of the regenerative tube 220.

The cross-sectional view of the communicating path 282 in the direction substantially parallel to the flow direction of the working gas may not curve and may be a bent shape like a square bracket ("[" is rotated for 90° in a clockwise direction.

(Evaluation Test of Cooling Capability)

Next, in order to confirm the effect of the embodiment, cooling capability was evaluated for the U-shaped pulse-tube refrigerator of the embodiment.

For an example, the second U-shaped pulse-tube refrigerator 210 that includes the cooling stage 280 as illustrated in FIG. 7 was used. For a comparative example, the U-shaped pulse-tube refrigerator 100 illustrated in FIG. 1 that includes the cooling stage 180-2 as illustrated in FIG. 3 was used. Thus, the difference between the example and the comparative example is that whether the flow smoothing member structured by the block shaped structure 260 is provided or not.

For the evaluation of the cooling capability of the refrigerators, electric power index-values (Watts) when cooling the object to be cooled 130 or 230 is cooled to 77K was measured.

As a result of measurement, for the U-shaped pulse-tube refrigerator of the comparative example, the electric power index-value was 128.5 W. On the other hand, for the second U-shaped pulse-tube refrigerator 210 of the example, the electric power index-value was 146.5 W. Thus, according to the embodiment, by providing the block shaped structure 260, cooling capability of the second U-shaped pulse-tube refrigerator 210 was significantly improved compared with the structure without the block shaped structure 260.

According to the embodiment, the U-shaped stirling pulse-tube refrigerator whose cooling efficiency is significantly improved is provided.

The present invention is not limited to the specifically disclosed embodiments, and numerous variations and modifications and modifications may be made without departing from the spirit and scope of the present invention.

What is claimed is:

1. A U-shaped pulse-tube refrigerator comprising:

a regenerative tube and a pulse-tube that are juxtaposed with each other;

a communicating path that connects a low-temperature end of the regenerative tube and a low-temperature end of the pulse-tube;

a heat exchanger that is provided at the low-temperature end of the regenerative tube; and a flow smoothing member that is provided at a first exit of the communicating path at a side where the regenerative tube is connected so that the flow smoothing member is located between the first exit of the communicating path and the heat exchanger.

2. The U-shaped pulse-tube refrigerator according to claim 1, wherein the flow smoothing member is provided to contact the first exit of the communicating path.

3. The U-shaped pulse-tube refrigerator according to claim 1, wherein the flow smoothing member is provided with a plurality of through holes that are formed along a direction substantially parallel to the longitudinal direction of the at least one of the regenerative tube and the pulse-tube, and/or a plurality of through holes that radially extend from the first exit of the communicating path toward the heat exchanger.

4. The U-shaped pulse-tube refrigerator according to claim 1, wherein the flow smoothing member is provided with a plurality of through holes that are radially formed along a direction substantially perpendicular to the longitudinal direction of the at least one of the regenerative tube and the pulse-tube.

5. The U-shaped pulse-tube refrigerator according to claim 1, further comprising:

a space portion provided between the heat exchanger and the first exit of the communicating path, the space portion having a tapered shape whose diameter increases from the first exit of the communicating path toward the heat exchanger.

6. The U-shaped pulse-tube refrigerator according to claim 1, wherein the heat exchanger is provided at the low-temperature end of the regenerative tube and the first exit of the communicating path is at the low-temperature end side of the regenerative tube.

7. The U-shaped pulse-tube refrigerator according to claim 1, wherein the flow smoothing member includes a block body that is provided to block flow of a gas from the first exit of the communicating path toward the heat exchanger, the block body being provided with a plurality of through holes such that the gas flows through the plurality of through holes from the first exit toward the heat exchanger.

8. The U-shaped pulse-tube refrigerator according to claim 7, wherein the block body is provided to block the first exit.

* * * * *